US007284946B2

(12) United States Patent
O'Neil

(10) Patent No.: US 7,284,946 B2
(45) Date of Patent: Oct. 23, 2007

(54) MOBILE SKID TURNER

(76) Inventor: John O'Neil, 758 Winding Willow Dr., Palm Harbor, FL (US) 34683

( * ) Notice: Subject to any disclaimer, the term of this patent is extended or adjusted under 35 U.S.C. 154(b) by 344 days.

(21) Appl. No.: 11/075,137

(22) Filed: Mar. 8, 2005

(65) Prior Publication Data

US 2006/0204351 A1 Sep. 14, 2006

(51) Int. Cl.
*B07C 1/18* (2006.01)

(52) U.S. Cl. ..... 414/763

(58) Field of Classification Search ..... 414/758, 414/763, 766, 729, 738, 421, 405, 622, 425
See application file for complete search history.

(56) References Cited

U.S. PATENT DOCUMENTS

| | | | | |
|---|---|---|---|---|
| 2,520,252 | A * | 8/1950 | Mutchler | 414/622 |
| 2,769,557 | A | 11/1956 | Ohr | |
| 2,838,184 | A | 6/1958 | Maccurdy | |
| 2,865,517 | A * | 12/1958 | Alford | 414/766 |
| 3,027,031 | A * | 3/1962 | Woodward et al. | 414/620 |
| 3,426,927 | A * | 2/1969 | Woodward | 414/620 |
| 3,438,525 | A | 4/1969 | Nutter | |
| 3,497,082 | A | 2/1970 | Flitter | |
| 3,547,279 | A | 12/1970 | Radomski | |
| 3,670,903 | A | 6/1972 | Hamilton | |
| 3,738,519 | A | 6/1973 | Edwards | |
| 3,770,141 | A | 11/1973 | Tolf et al. | |
| 3,895,722 | A * | 7/1975 | Pluntz | 414/766 |
| 3,908,836 | A * | 9/1975 | Ikeda | 414/788.4 |
| 4,173,428 | A | 11/1979 | Thornberg | |
| 4,295,776 | A | 10/1981 | Payne et al. | |
| 4,498,841 | A | 2/1985 | Wickstrom | |
| 5,228,716 | A * | 7/1993 | Dahl | 280/651 |
| 5,295,309 | A * | 3/1994 | Kozlowski et al. | 34/444 |
| 5,743,374 | A * | 4/1998 | Monsees | 198/403 |
| 6,234,467 | B1 | 5/2001 | Runzi | |
| 6,595,740 | B1 * | 7/2003 | Drake et al. | 414/796.8 |
| 6,655,268 | B2 * | 12/2003 | Comley et al. | 100/319 |
| 6,793,454 | B2 | 9/2004 | Brizzi | |

* cited by examiner

*Primary Examiner*—Saul Rodriguez
*Assistant Examiner*—Joshua I Rudawitz
(74) *Attorney, Agent, or Firm*—Dennis G. Lapointe

(57) ABSTRACT

A mobile skid turner for inverting skid loads of paper includes an H-shaped base frame portion with casters for facilitating movement in desired directions and opposing upright structural members at an intermediate location. A rotatable shaft facilitates the rotational inverting of the product. A first and second set of forks are included for engaging an underlying side of a skid pallet located under a product to be inverted and for engaging an overlying side of another skid pallet overlying the product to be inverted. Sensors and limit switches located on at least one member of each of the forks are included for stopping a clamping action of the forks at a predetermined clamping setting. The rotation action is power assisted. Controls are provided for selectively controlling the clamping action and the rotation action of the product.

11 Claims, 9 Drawing Sheets

MOBILE SKID TURNER

FIELD OF THE INVENTION

The invention relates to a mobile inverting skid device for use in the printing industry and other industries where there is a need for mobile equipment to invert or otherwise rotate a skid containing a product for continuing processing or production of said product.

BACKGROUND OF THE INVENTION

Although the invention can relate to other analogous or similar industries, by way of background, the printing industry will be discussed herein. In most short-run printing shops, about 25,000 sheets, more or less, need to be printed on one side of the paper and then those sheets need to be turned over for printing the opposite side as soon as possible.

However, until the ink has dried, the paper cannot be compressed or it will stick together, which causes offsetting. In short-run shops, it is necessary to print the opposite side and not wait until the ink has finished drying. In order to do this, the paper has to be turned over by hand, placed on a skid and fed back into the press so the second side can be printed.

Skid turners known in the art are typically not movable or mobile and those that are mobile are manually operated such as the hand pushed mini-fork lifts and the rotation or inverting function is not done in a backward motion. Also, in prior art devices, the paper needs to be compressed, otherwise, the paper will fall out on to the floor as the rotation function is performed. Further, aeration means is not present in mobile unit known in the art, and ink sticking problems are encountered when the forks over-compress the paper stack because the prior art mobile devices need to compress the paper stack in order to perform the inverting function. Therefore, care must be taken to take the time to let the ink dry before attempting to handle the skid with current prior art mobile devices.

The reason why the prior art skid turners have to compress the paper between the two skids or pallets is because they turn the paper in a clockwise or counter-clockwise inverting or rotation movement. If the paper comes loose during the turn, it will end up sliding and will not be centered on the skid or will fall onto the floor.

What is needed is a movable skid turner that will not compress the paper and will aerate it.

SUMMARY OF THE INVENTION

The present invention is a mobile skid turner that turns the paper over in a motion such that it lifts the paper up and over in a backward position and sets it sown on the opposite side. During the clamping sequence, limit switches/sensors prevent the paper from being compressed, and since the paper is inverted by a backward rotation movement, the paper cannot fall out.

The device is self-contained with its own DC electric system, is capable of moving to any area of a typical printing plant and will work on 60-inch presses or smaller, although it could be modified to handle larger presses, if necessary.

General Functions of the Mobile Skid Turner

The mobile skid turner is pushed forward on four casters. As the skid turner is pushed forward, the frame straddles the skid of paper and the forks move under the skid.

A skid is placed upside down on stack of paper so that when the paper stack in inverted, the paper will be on a skid.

A button on the control panel is activated to initiate the clamping action. The forks underlying the bottom skid and the forks overlying the upper skid close together. Note the forks closing together can be accomplished by hydraulic cylinders; air cylinders; chains and sprockets, power supplied by AC power or 12V or 24V DC gear motor; although DC power is preferred; ACME® screw means with AC or DC power supplied; or a combination of any of the above actuating means.

The forks stop closing when the sensor means/limit switches are triggered. Note when the limit switches are triggered, they stop the forks from crushing the paper between two skids; thus the paper will not stick together or offset. One way to design the limit switches is to wire the switch(es) to a circuit board. When the forks with the load starts to rise, the limit switch on the bottom is compressed. As the load rises, the top forks come down. When the limit switch (which may be located on the side of the fork) meets the top skid, it compresses and a signal is sent to the circuit board thus stopping the closure of the forks.

Using the control panel, the rotation or inverting function is activated and the skid of paper is rotated 180 degrees on its axis. The paper slides down the skids and rests on a platform. The paper typically moves about 1-½" or less. The rotation can be accomplished by hydraulic cylinders; air cylinders; chains and sprockets, power supplied by AC power or 12V or 24V DC Gear Motor; although DC power is preferred; acme screw means with AC or DC power supplied; or a combination of any of the above actuating means.

The skid of paper can be aerated at any time it is in a horizontal position.

To aerate the paper, the control panel includes an air actuation control. The air is pushed up through the platform by means of small holes. The whole load can be aerated or it can be done in sequence. The air compressor and tank is preferably located under the machinery table.

After the load of paper has turned 180 degrees (it is now on the opposite side of the axis), a control on the control panel activates the opening of the forks and the skid of paper is set down onto the floor.

A handle that is used for guiding and pushing the skid turner to the skid of paper is now on the opposite end and ready for another skid.

As an option, the air table can also be adapted to vibrate, thereby causing a vibration effect against the side of the paper stack.

DETAILED DESCRIPTION OF THE INVENTION

Figure 1:
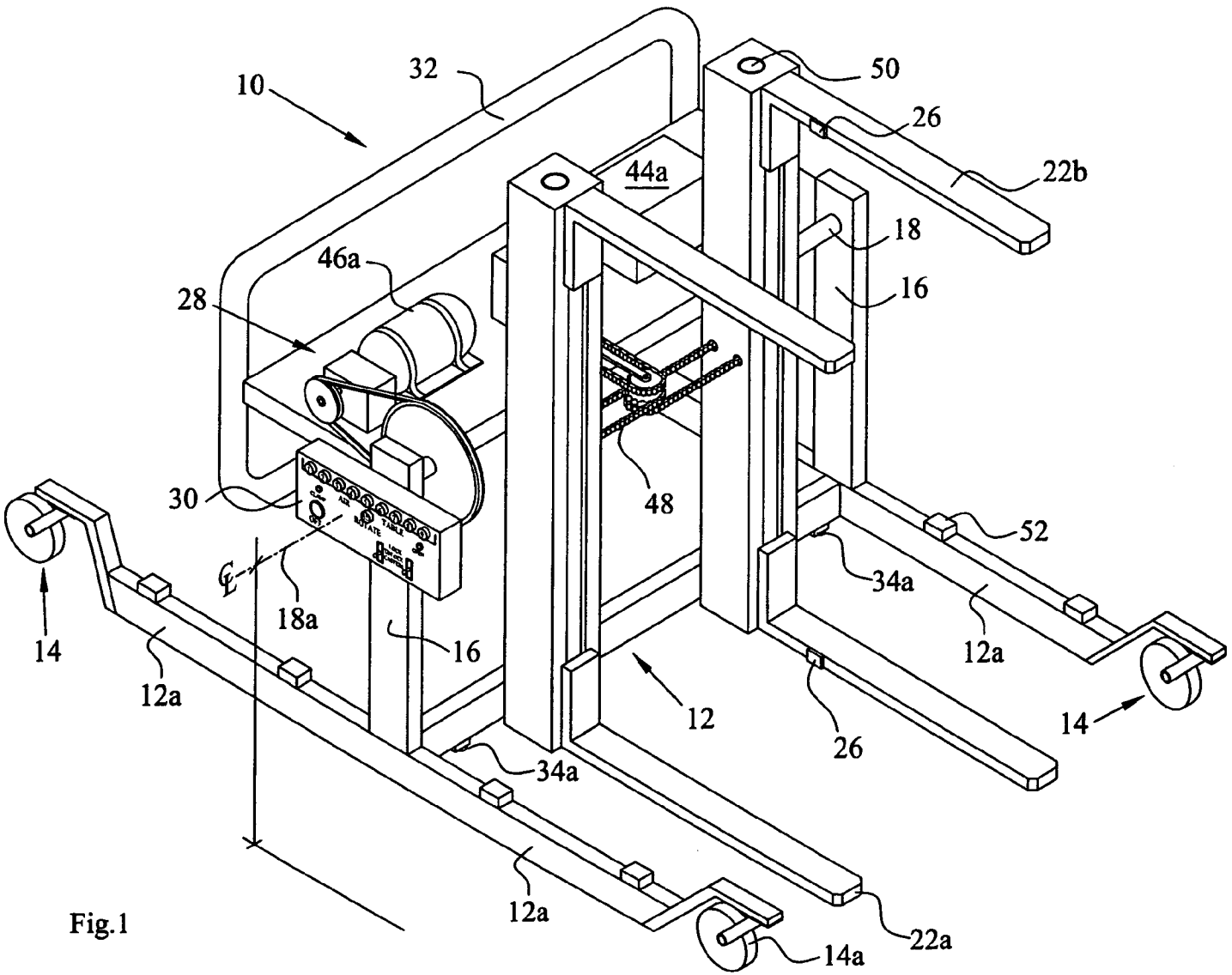
FIG. 1 is a perspective view of one embodiment conceptually representing the invention.
Figure 2:
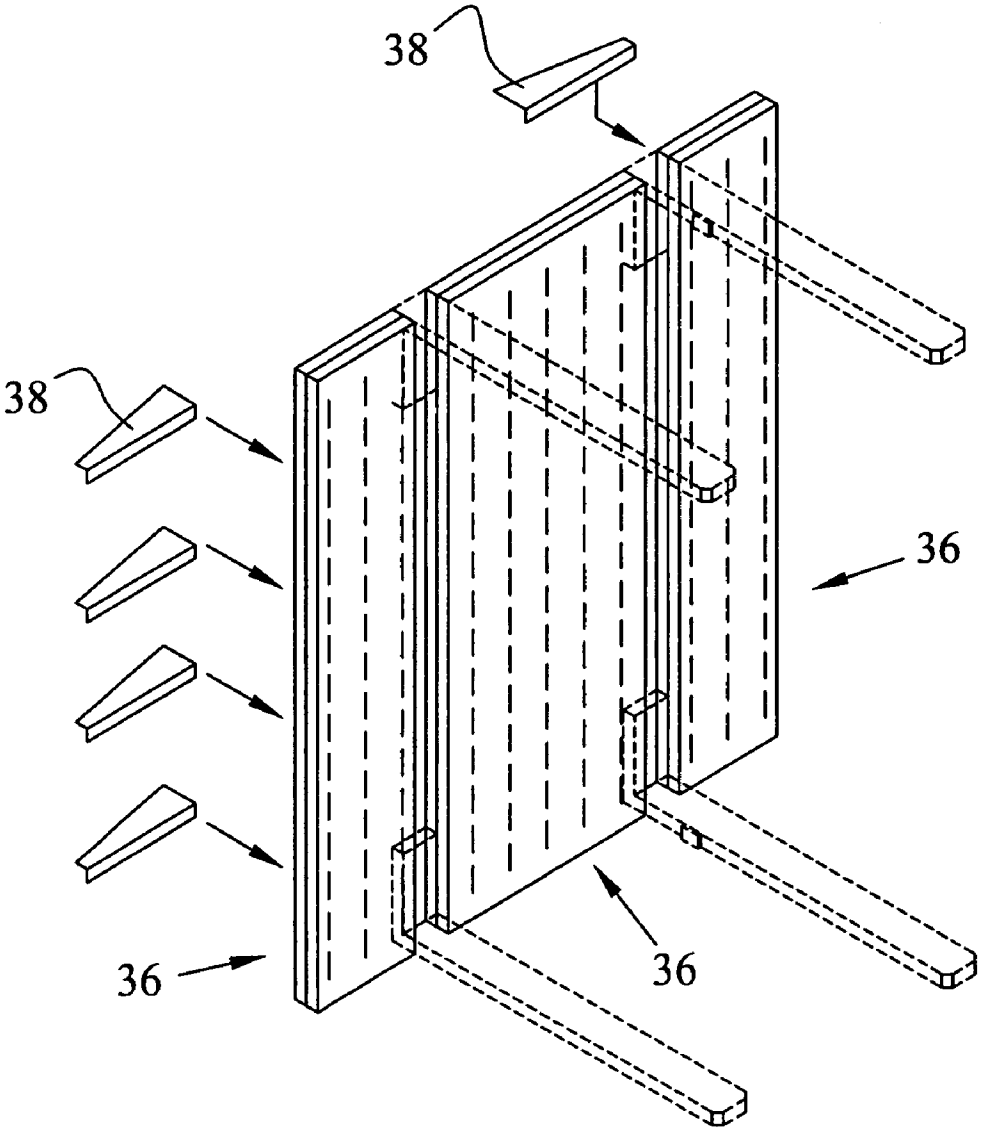
FIG. 2 is a conceptual depiction of an example of an aeration table system depicting the table platform itself configured in relation to the forks with typical brackets used to attach the aeration table to the mobile skid turner frame.

Referring now to the drawings, FIGS. 1-9 disclose an example of an embodiment of the present invention, which is a mobile skid turner and is depicted generally as 10.

The mobile skid turner 10 comprises an H-shaped base frame portion 12 having wheel means 14 at approximate ends of each leg 12*a* of said base frame portion 12 for facilitating movement of the mobile skid turner in desired directions, said wheel means 14 being adapted to allow for swivel motion on at least two of said wheel means 14.

At an intermediate position of the base frame portion 14 are opposing upright structural members 16. The invention 10 includes a rotatable shaft means 18, which has an axis of rotation 18*a* about which a skid 20 of product 20*a* may be inverted. The shaft means 18 extends from near an end of one upright structural member 16 to an end of the opposing upright structural member 16.

The skid turner 10 has first fork means 22*a* for engaging an underlying side of a skid pallet 20*b* located under a product 20*a* to be inverted and second fork means 22*b* for engaging an overlying side of another skid pallet 20*c* overlying the product 20*a* to be inverted.

The skid turner 10 includes means 24 for activating the first and second fork means 22*a*,22*b* to engage or disengage from contact with the skid pallets. Examples of such means are described below. Sensor and limit switches 26 are located on at least one member of each of the first and second fork means 22*a*,22*b* for stopping a clamping action of the fork means 22*a*,22*b* at the predetermined clamping setting.

To rotate the clamped product 20*a*, power assist means 28 is provided so that the inversion/rotation process can be accomplished with relative ease. Again examples of methods known in the art to provide such power assistance are described below.

Figure 3:
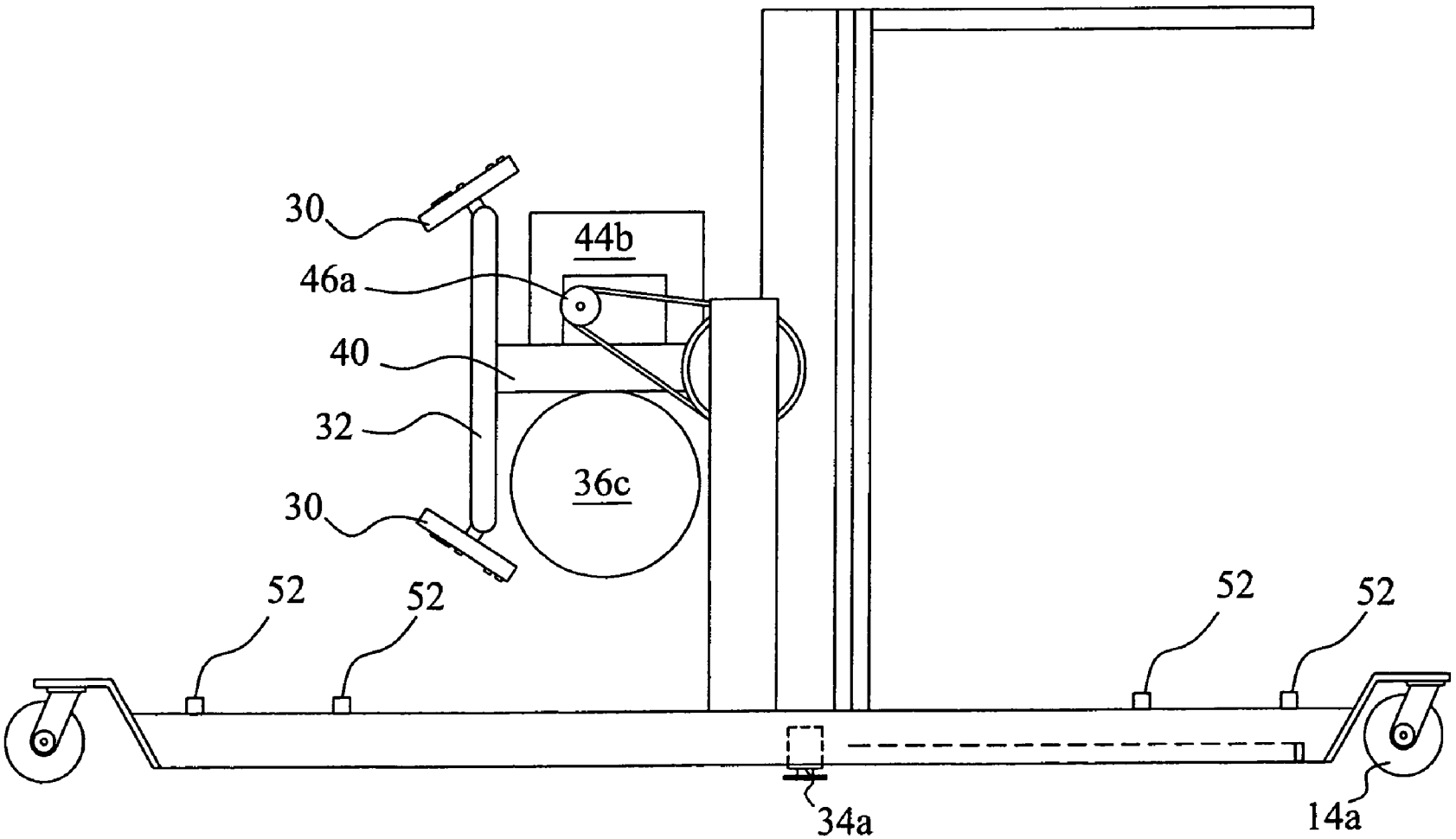
FIG. 3 is a side view of the embodiment of FIG. 1.
Figure 4:
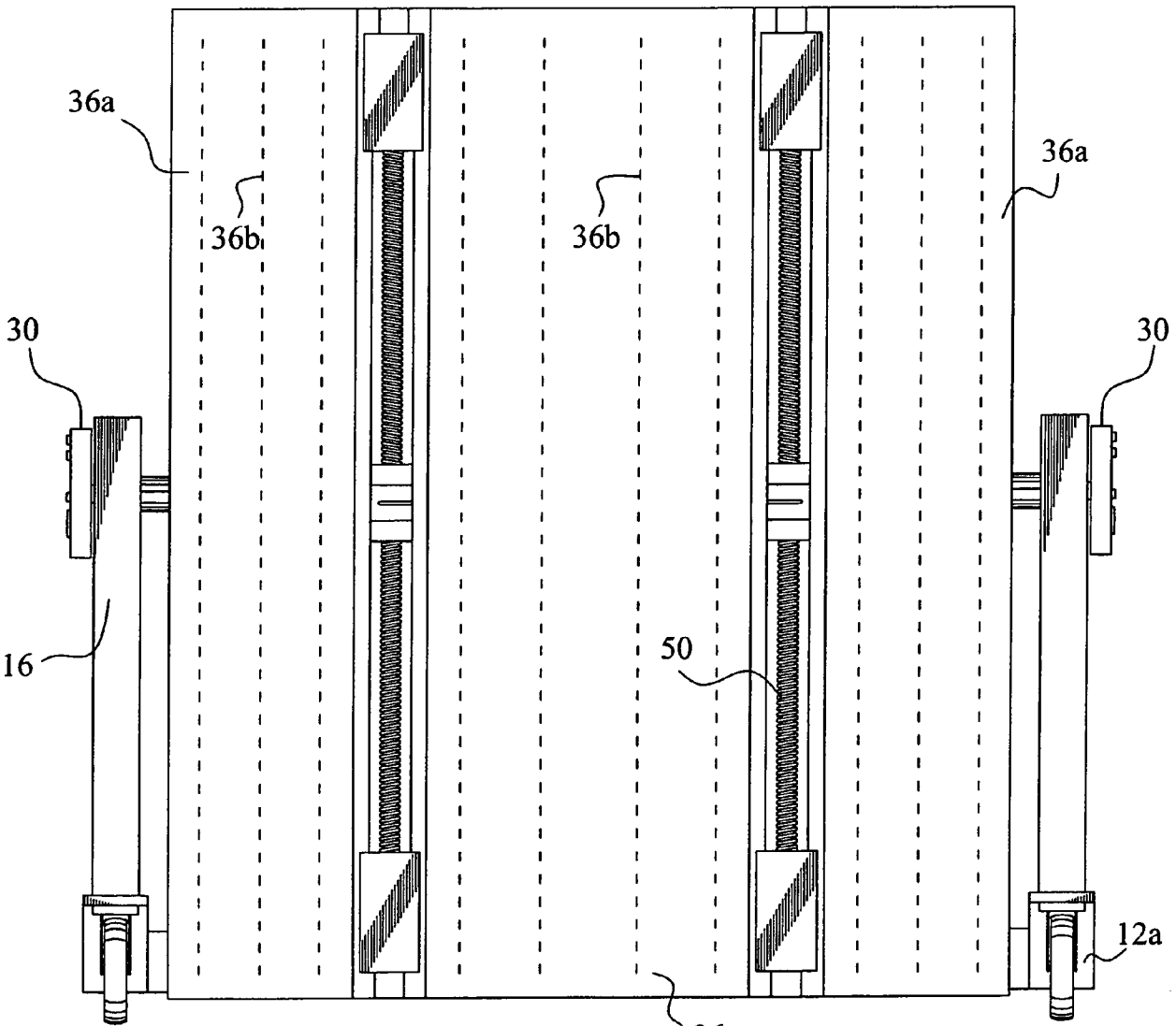
FIG. 4 is a frontal view of the embodiment of FIG. 1 depicting control consoles on both side and an example of actuating means to open and close the forks.
Figure 9:
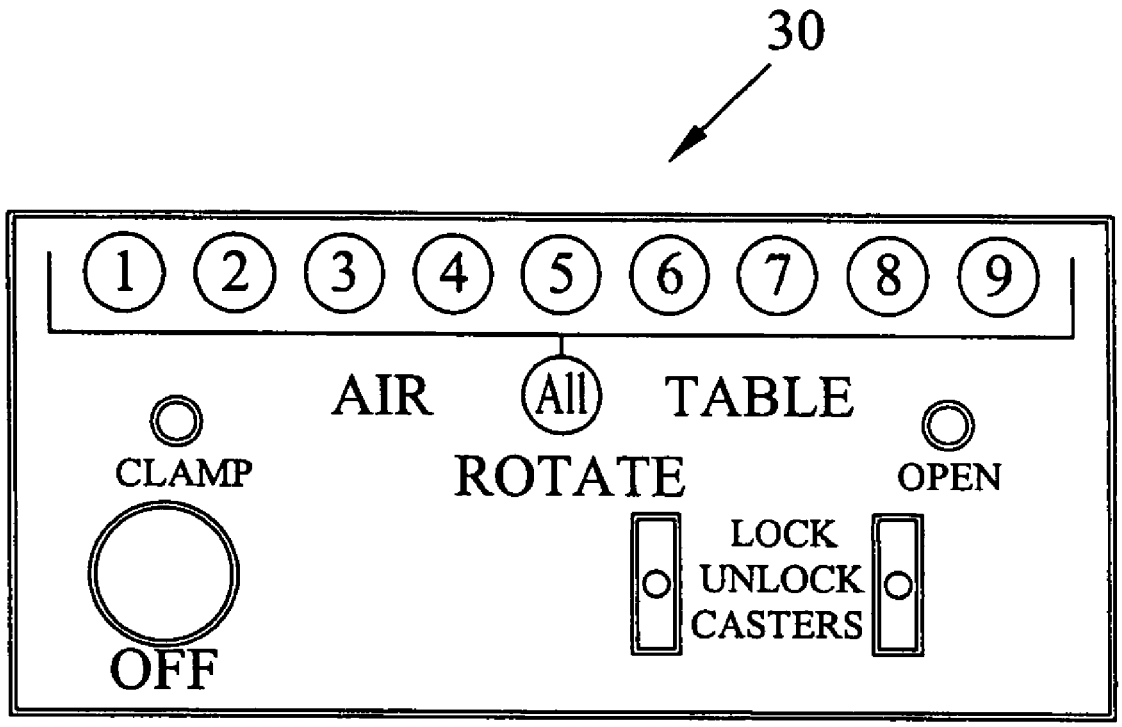
FIG. 9 is a conceptual depiction of a typical console face with examples of various controls.

The invention 10 further includes controller means 30 for selectively controlling the clamping action and the rotation action of the product 20*a*. Controller means 30 may be provided in the form of a control panel or console at a readily accessible portion of the invention or in a remote controllable console. Regardless, it should be located such that an operator can manipulate the controls without having to do any significant bending or reaching. In the drawings, the console with the controls is shown attached near the upper end of the sides of the upright structural members 16. One embodiment can include a redundant system where a control console is located on both members 16 as shown in FIG. 4. In another embodiment contemplated as within the scope of the invention 10, the control console may be located on handle 32, as shown in FIG. 3. In this latter embodiment, it is preferable that the handle 32 be extended vertically so to be readily reached for manipulation without any significant bending to cover both ends of the rotation spectrum and that a redundant control system be incorporated on the handle 32 for ease of operation no matter what the rotation sequence is. FIG. 9 depicts a representative example of a control console face with controls such as a control to unlock/lock the casters 14*a*, selectively operate the air table valves 36*a*, or to initiate the rotation, clamping and opening actions.

It is preferred that at least two of the wheel means 14 include means for locking the wheels 14*a* to prevent movement of the skid turner 10 along a floor or ground surface. Locking means can be done in a number of ways known in the art. One preferable method is by the use of floor clamps or air cylinders 34*a* where a ram is lowered and engages with the floor, preferably rated at 100 pounds. Preferably, this function would be manipulated or activated by a control lever or switch located on the control console 30.

Figure 8:
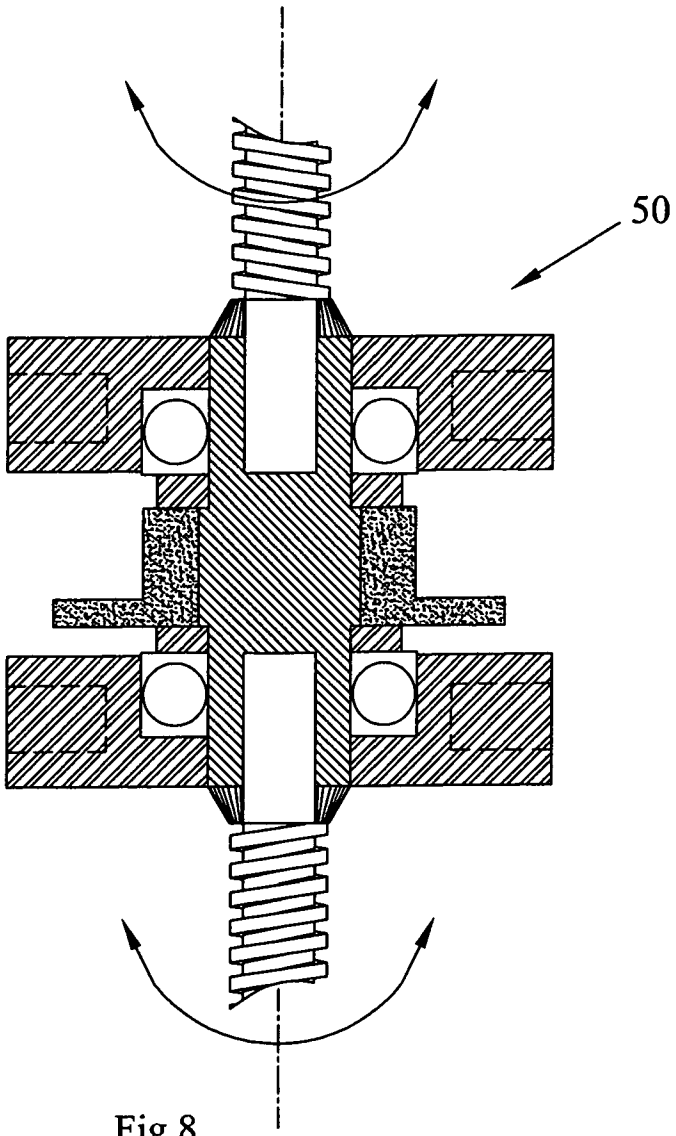
FIG. 8 is a conceptual depiction of an example of way to join the ACME® screws at an intermediate location to facilitate the opening and closing of the forks.

The power assist means 28 for rotating the clamped product 20*a* can be provided in a number of ways known in the art, for example, hydraulic cylinder systems, air cylinder systems; chains and sprockets systems power supplied by AC power or a 12V or 24V DC gear motor system; an ACME® screw system which is AC or DC power supplied; or any combination of these. Similarly, the means 24 for activating the fork means 22*a*,22*b* to engage or disengage from contact with the skid pallets 20*b*,20*c* can be made from systems using hydraulic cylinders, air cylinders, chains and sprockets power supplied by AC power or 12V or 24V DC gear motors, ACME® screw with AC or DC power supplied, or any combination of these. FIGS. 1, 3, 4 and 6 depicts an example of typical components listed above, for example, battery charger 42, batteries 44*a*,44*b*, gear motors 46*a*,46*b*, chain and sprocket system 48 for the operation of an ACME® screw system 50 (see FIG. 4) that is in cooperative mechanical engagement with the forks 22*a*,22*b* to facilitate the clamping action of the forks 22*a*,22*b*. In the example of the embodiment shown, ACME® screw system 50 is utilized in lieu of hydraulic or air cylinder systems. In this example, FIG. 8 is cross-sectional representation of a typical mechanical assembly depicting the joining of the ACME® screws 50 at an intermediate position. This portion of the ACME® screw system 50 mechanically cooperates with the shown chain and sprocket system 48.

Preferably, aeration means 36 is provided with the invention 10 for aerating the clamped product 20*a* when desired. This can be provided by incorporating an aeration table 36*a* having a plurality of spaced-apart apertures 36*b* on a face thereof. The apertures 36*b* are in fluid communication with a pressurized air supply system. The face and apertures are in a face-to-face relationship with the clamped product 20*a*. The aeration table is configured or formed to accommodate the forks 22*a*,22*b* therein generally forming into three portions, one intermediate a vertical plane extending between each opposing first and second set of forks and the other two portions each being located outside said vertical planes.

In another embodiment, the mobile skid turner 10 can include sensor means 52 located on the skid base frame portion 12 for detecting and preventing a person from walking into an open end of the folk means 22*a*,22*b* while mobile skid turner 10 is in motion. This could be accomplished by incorporating sensors that emit a beam (invisible) of light between sensors. If the beam is broken, it would send a signal to a circuit board which would be in electrical communication with the power circuitry in such a way as to shut down the machine. Although the drawings depict two sensors on each leg of the frame, one sensor will work as well.

In still another embodiment, it may be desirable for the mobile skid turner 10 to include means 54 for causing a vibration action of said aeration table 36*a*. This can typically be done by clamping a vibration motor to the outside of the air table 36*a*.

As mentioned above, the mobile skid turner 10 further comprises handle means 32 for guiding and maneuvering the skid turner 10. The handle means 32 preferably extend vertically from either side of a plane of the axis 18*a* of the rotatable shaft 18 to accommodate accessibility to the handle 32 by the operator. The drawings depict one example of a formed handle 32 that would satisfy the accessibility preference.

General Functions of the Mobile Skid Turner

The mobile skid turner 10 is pushed forward on four casters 14*a*. As the skid turner 10 is pushed forward, the frame 12 straddles the skid 20 of paper and forks 22*a* move under the skid pallet 20*b*.

A skid pallet 20*c* is placed upside down on the stack of printed product 20*a*.

A control mechanism on the control panel 30 labeled "clamp" is activated. Forks 22*a* forks 22*b* close together. As alluded to above, the forks closing together can be accomplished by systems such as hydraulic cylinder systems; air cylinder systems; chains and sprocket systems and be power supplied by a 24V DC gear motor; an ACME® screw system; or a combination of any of these systems.

The forks 22*a*,22*b* stop closing when the limit switches 26, which are located on the forks 22*a*,22*b* are triggered. Note when the limit switches 26 are triggered, they stop the forks from crushing the product 20*a* between the two skid pallets 20*b*,20*c*; thus the printed paper product 20*a* will not stick together or offset.

A control mechanism on the control panel 30 labeled "rotate" is activated and the skid 20 of paper product 20*a* is rotated 180 degrees on axis 18*a*. The paper product 20*a* typically slides down the skid pallets 20*b*,20*c* and rests on air table 36*a*. Typical sliding movement may be about 1.5 inches or less. As alluded to above, the rotation action can be facilitated using systems such as hydraulic cylinder systems; air cylinder systems; chains and sprocket systems and be power supplied by a 24V DC gear motor; an ACME® screw system; or a combination of any of these systems.

The skid of paper can be aerated at any time it is in a horizontal position.

Figure 5:
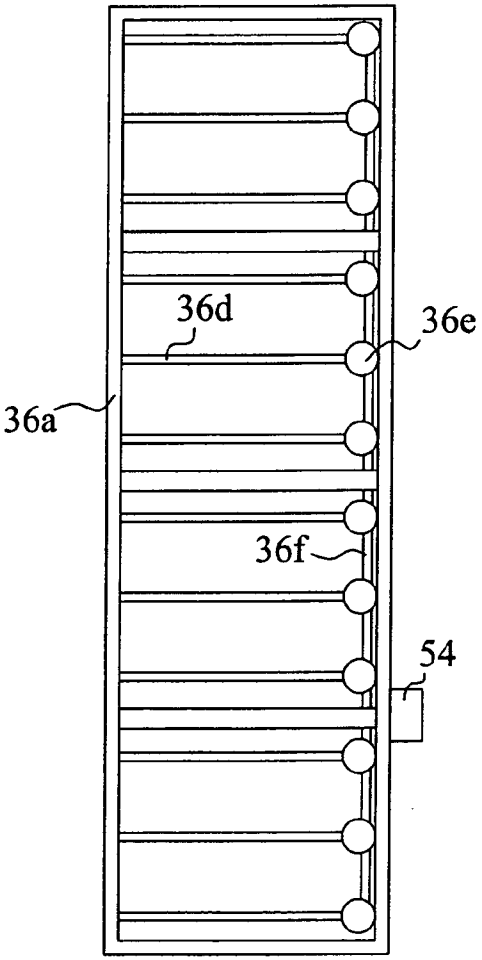
FIG. 5 is a back view of a typical air table conceptually depicting typical components such as air lines, air valve and an optional vibration motor.
Figure 6:
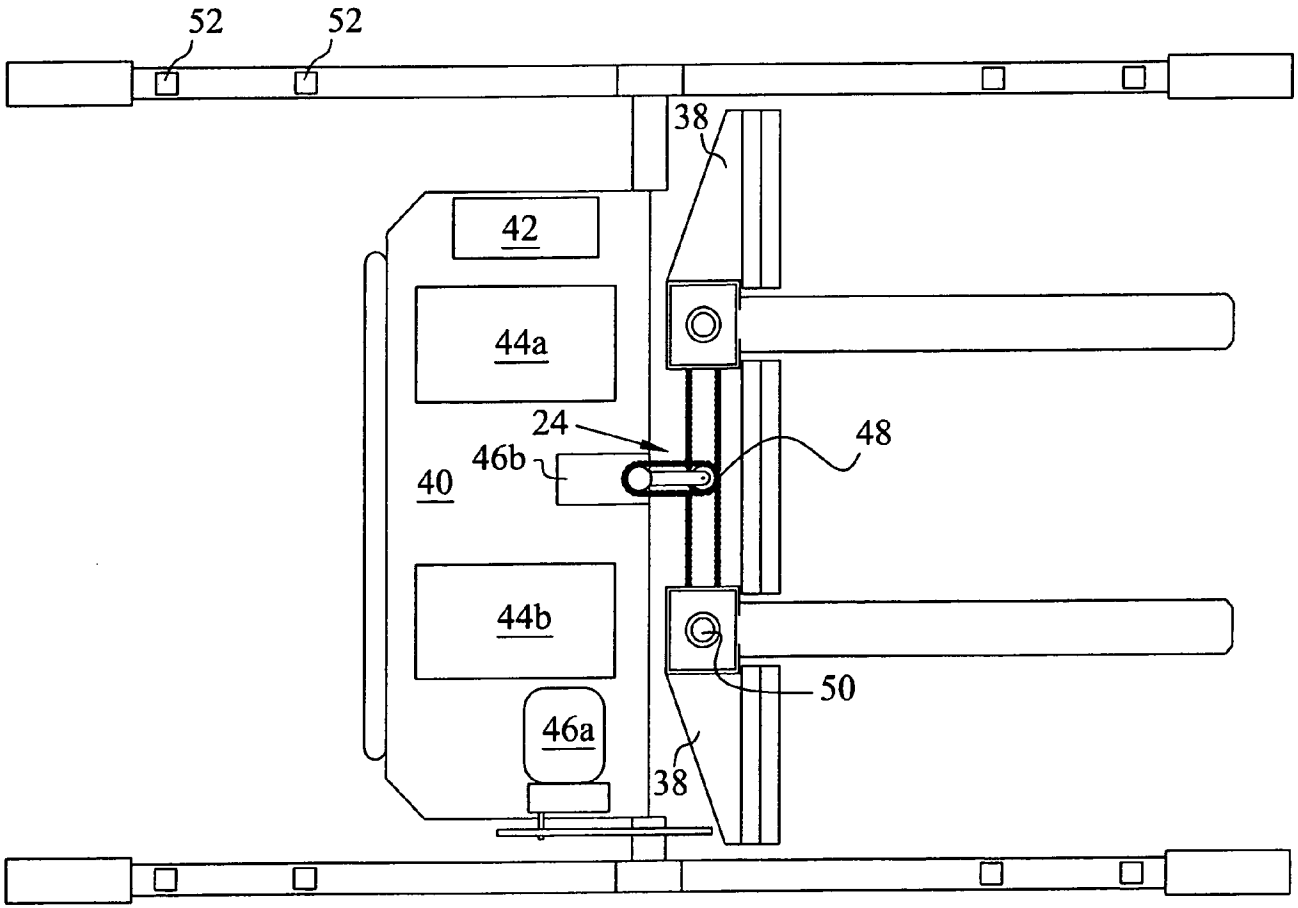
FIG. 6 is a plan view of the embodiment of FIG. 1.
Figure 7:
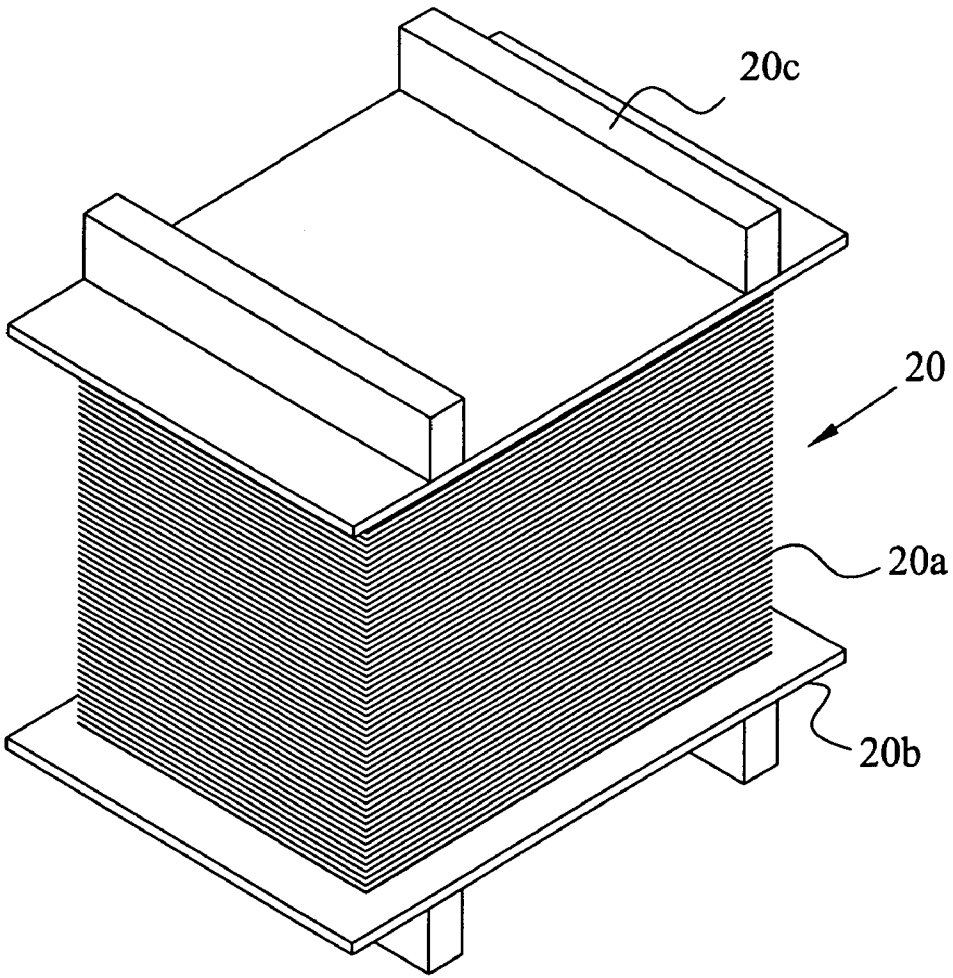
FIG. 7 is a schematic representation of a skid depicting printed paper product between two pallets.

To aerate the paper, an operator would activate the air system at the control panel 30. The air is pushed up through the air table 36*a* through small holes 36*b* as shown in FIG. 4. The whole load can be aerated or it can be done in sequence. FIG. 5 shows a representative conceptual view of an aeration system, that is, the back of a typical air table, incorporating tracks for air 36*d*, electric air valves 36*e* and air supply lines 36*f*, e.g. hose, which is in fluid communication with the air compressor/air tank system 36*c*. FIG. 3 depicts an example of the mounting of the air compressor/air tank components under a machinery table 40. The air table 36*a* is typically secured to the mobile skid turner 10 using brackets 38 made to suit the installation and installed so as to not interfere with the operation of the forks 22*a*,22*b*. The brackets 3 would secure the table 36*a* to the frame structure of the mobile skid turner 10.

After the load of paper product 20*a* has turned 180 degrees (it is now on the opposite side of axis 18*a*, a control mechanism on the control panel 30 labeled "open" is activated. The forks 22*a*,22*b* open and the skid of paper product 20*a* is set down onto the floor.

Handle 32 is now on the opposite end and ready for another skid 20.

Pallet guides can also be incorporated with the invention. Typically, they could be steel guides that would fold down to help center up the skid when the skid turner is pushed forward on the skid. In addition, a television monitor could also be included, where a lens would be placed in the middle of the air table and a TV monitor would be located at the handle. This would help line up the machine on the skid.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A mobile skid turner for inverting skid loads of paper and the like, comprising:

an H-shaped base frame portion having wheel means at approximate ends of each leg of said base frame portion for facilitating movement of the mobile skid turner in any desired directions, said wheel means being adapted to allow for swivel motion on at least two of said wheel means;

at an intermediate position of said base frame portion are opposing upright structural members;

Rotatable shaft means for inverting a skid of product about an axis of rotation, said axis of rotation being transversely oriented and aligned perpendicularly to a vertical plane extending vertically from side members of said H-frame portion, said side members being spaced-apart so as to be outside a load inversion operating envelope during operation of said skid turner;

a first fork means for engaging an underlying side of a skid pallet located under a product to be inverted and a second fork means for engaging an overlying side of another skid pallet overlying the product to be inverted;

means for activating said first and second fork means to engage or disengage from contact with said skid pallets;

sensor and limit switch means located on at least one member of each of said first and second fork means for stopping a clamping action of the fork means at a predetermined clamping setting;

power assist means for rotating the clamped product about the axis of rotation of the rotatable shaft means;

controller means for selectively controlling the clamping action and the rotation action of the product;

handle means for guiding and maneuvering the skid turner, said handle means extending vertically from either side of a plane of the axis of the rotatable shaft to accommodate accessibility to said handle means by an operator; and at least two of said wheel means include means for locking said wheel means to prevent movement of the skid turner.

2. The mobile skid turner according to claim 1, wherein the power assist means for rotating the clamped product comprises one of:

hydraulic cylinder means, air cylinder means; chains and sprockets means power supplied by AC power or 12V or 24V DC gear motor means; ACME® screw means with AC or DC power supplied; or any combination thereof

3. The mobile skid turner according to claim 1, wherein the means for activating said fork means to engage or disengage from contact with said skid pallets comprises one of:

hydraulic cylinder means, air cylinder means; chains and sprockets means power supplied by AC power or 12V or 24V DC gear motor means; ACME® screw means with AC or DC power supplied; or any combination thereof.

4. The mobile skid turner according to claim 1, aeration means for aerating the clamped product when desired.

5. The mobile skid turner according to claim 4, wherein the aeration means comprises an aeration table having a plurality of spaced-apart apertures on a face thereof, said apertures being in fluid communication with pressurized air supply means, said face being in a face-to-face relationship with the clamped product.

6. The mobile skid turner according to claim 5, wherein the aeration table is comprised of three portions, one intermediate a vertical plane extending between each opposing first and second fork means and the other two portions each being located outside said vertical planes.

7. The mobile skid turner according to claim 1, wherein the controller means comprises a control console attached to a desired accessible location on one side of the mobile skid turner.

8. The mobile skid turner according to claim 1, wherein the controller means comprises a dual control system having a control console attached to a desired accessible location on both sides of the mobile skid turner.

9. The mobile skid turner according to claim 1, further comprising sensor means located on the skid base frame portion for detecting and preventing a person from walking into an open end of the folk means while mobile skid turner is in motion.

10. The mobile skid turner according to claim 5, further comprising means for causing a vibration action of said aeration table.

11. The mobile skid turner according to claim 1, wherein the means for locking said wheel means is remotely controlled from a control console.

* * * * *